US006962484B2

(12) United States Patent
Brandl et al.

(10) Patent No.: US 6,962,484 B2
(45) Date of Patent: Nov. 8, 2005

(54) MOVING BLADE FOR A TURBOMACHINE

(75) Inventors: Herbert Brandl, Waldshut-Tiengen (DE); Alexander Hoffs, West Palm Beach, FL (US)

(73) Assignee: ALSTOM Technology LTD, Baden (CH)

( * ) Notice: Subject to any disclaimer, the term of this patent is extended or adjusted under 35 U.S.C. 154(b) by 22 days.

(21) Appl. No.: 10/407,251

(22) Filed: Apr. 7, 2003

(65) Prior Publication Data

US 2003/0194322 A1 Oct. 16, 2003

(30) Foreign Application Priority Data

Apr. 16, 2002 (CH) ..... 2002 0636/02

(51) Int. Cl.[7] ..... F01D 5/20

(52) U.S. Cl. ..... 416/192; 416/190; 416/191; 415/173.4; 415/173.5; 415/173.6

(58) Field of Search ..... 416/189, 190, 416/191, 192; 415/173.1, 173.4, 173.5, 173.6, 228

(56) References Cited

U.S. PATENT DOCUMENTS

| | | | | |
|---|---|---|---|---|
| 3,867,060 A | * | 2/1975 | Huber | 415/173.5 |
| 4,643,645 A | * | 2/1987 | Robbins et al. | 416/191 |
| 6,068,443 A | * | 5/2000 | Aoki et al. | 415/173.5 |
| 6,241,471 B1 | | 6/2001 | Herron | |

FOREIGN PATENT DOCUMENTS

| | | |
|---|---|---|
| JP | 11-350902 | 12/1999 |
| JP | 2001-193405 | 7/2001 |

OTHER PUBLICATIONS

EPO Search Report, dated May 8, 2003.

Patent Abstracts Of Japan, vol. 2000, No. 03, Mar. 30, 2000, –& JP 11 350902 A (Ishikawajima Harima Heavy Ind Co Ltd), Dec. 21, 1999, Zusammenfassung Abbildungen 1A, 1B (5 pp).

Patent Abstracts Of Japan, vol. 1000, No. 24, May 11, 2001, –& JP 2001 193405 A (Mitsubishi Heavy Ind Ltd), Jul. 17, 2001 Zusammenfassung (6 pp).

Seach Report, prepared by the European Patent Office, for Swiss Appl. No. CH 6362002, issued on Jul. 18, 2001.

* cited by examiner

*Primary Examiner*—Christopher Verdier
(74) *Attorney, Agent, or Firm*—Cermak & Kenealy LLP; Adam J. Cermak

(57) ABSTRACT

This arrangement relates to a moving blade (1), cast in one piece, for a turbomachine, in particular a turbine or compressor, comprising an aerodynamically shaped profile body (2) which has a shroud band (5). The shroud band (5) projects beyond the profile body (2) in the circumferential direction (6) and has a fin (12). The fin (12) possesses a base portion (14), a transitional portion (15) and a sealing portion (16). An axially measured wall thickness decreases in a transitional portion (15) from the base portion (14) to the sealing portion (16). To avoid a porous structure in the base portion (14), two depressions (17), which reduce the wall thickness of the base portion (14), are integrally molded on the outside of the base portion (14).

10 Claims, 1 Drawing Sheet

MOVING BLADE FOR A TURBOMACHINE

This application claims priority under 35 U.S.C. § 119 to Swiss application number 2002 0636/02, filed Apr. 16, 2002.

TECHNICAL FIELD

The invention relates to a moving blade, cast in one piece, for a turbomachine, in particular for a turbine or for a compressor.

PRIOR ART

A moving blade of this type normally possesses an aerodynamically shaped profile body which, at its radially outer end, has an integrally molded shroud band which projects beyond the profile body in the circumferential direction. In the present patent application, the designations "radially", "axial" and "circumferential direction" refer to the installation state of the moving blade, the axis of rotation of a rotor, to which the moving blade is fastened, running axially in this sense and thus defining the coordinate system of the moving blade.

The shroud band formed at the moving blade tip, on the one hand, has a flow guide function, in that it prevents an undesirable flow around the profile body tips. On the other hand, the shroud band possesses a stabilizing function, since the dimensioning of the shroud band is such that, during operation, shroud bands of moving blades adjacent to one another in the circumferential direction are supported mutually one on the other and thereby reduce oscillations and vibrations of the moving blades.

So that, when the moving blade is in operation, the shroud band does not flex in an undesirable way in its portions projecting in the circumferential direction, the shroud band has integrally molded on it, radially on the outside, a reinforcing fin which extends in the circumferential direction along the shroud band and supports the latter. In the region of the fin, the shroud band is thereby designed virtually as a T-beam.

The fin additionally has a sealing function, since it obstructs an axial flow around the shroud band radially on the outside, particularly when, in the installation state, the fin engages into a complementary sealing contour, in order, for example, to form a labyrinth seal.

Since relatively high centrifugal forces occur when the moving blade is in operation, an attempt is made to design the shroud band and the fin to be as light as possible, that is to say with relatively small wall thicknesses. Such a fin may accordingly be composed of a plurality of portions. In particular, the fin has, at least in a region of the shroud band in which the profile body runs, a base portion connected to the shroud band, a transitional portion adjoining the base portion radially and/or in the circumferential direction and a sealing portion adjoining the transitional portion radially and/or in the circumferential direction. So that sufficient strength and dimensional stability can be ensured for the fin and the shroud band, an axially measured wall thickness in the base portion is markedly larger than in the sealing portion. Correspondingly, the wall thickness decreases in the transitional portion from the base portion to the sealing portion.

During the casting of the moving blade, the fin is molded by feeding, that is to say the liquid alloy is not introduced into the casting mold at the fin, but at another suitable point, so that the molding region forming the fin is fed or supplied with liquid alloy from the adjoining regions of the mold.

Since the alloy shrinks during solidification, it must be possible, during the solidification process, for liquid alloy to continue to flow, in order to avoid casting faults, for example porous structure or pores. Problems arise in this case, in the region of the base portion of the fin, since the base portion has a relatively large volume due to its larger wall thickness. The result of this is that the base portion, on the one hand cools relatively slowly and, on the other hand, during cooling, requires a relatively large amount of liquid alloy in order to avoid dimensional changes. Since, however, the portions of the moving blade which are contiguous to the fin, that is to say the shroud band and, indirectly, the profile body, usually have smaller wall thicknesses than the base portion, these thinner wall portions may, usually, solidify before the base portion of the fin, with the result that a further feed of material into the solidifying base portion is obstructed. Correspondingly, during the production of a moving blade of this type, casting faults occur relatively frequently in the region of the base portion of the fin. In order to take this into account, the feeding portions must be dimensioned correspondingly larger, thus increasing the mass of the blade tip, with the result that the moving blade is exposed to higher loads during operation.

PRESENTATION OF THE INVENTION

The invention is intended to remedy this. The invention, as characterized in the claims, is concerned with the problem of specifying, for a moving blade of the type initially mentioned, an improved embodiment which, in particular, reduces the occurrence of casting faults during production.

This problem is solved, according to the invention, by means of the subject of the independent claim.

Advantageous embodiments are the subject matter of the dependent claims.

The invention is based on the general idea of reducing the wall thickness in the base portion of the fin at at least one selected point. This is achieved, according to the invention, by means of at least one depression which is integrally molded on the outside of the base portion as early as during the casting of the moving blade. The proposed form of construction reduces the volume of the base portion, with the result that the latter, on the one hand, during casting, can solidify more quickly and, on the other hand, during solidification, requires a lower afterfeed of liquid alloy in order to maintain the desired shape.

By an optimization of the shape and position and, if appropriate, of the number of depressions of this type, the fin can ensure its carrying function sufficiently reliably, while having a reduced mass and/or regions of reduced wall thickness.

Correspondingly, the risk of casting faults in the region of the base portion of the fin is reduced.

In a development, at least two depressions may be provided, which are arranged opposite one another with respect to a plane extending in the circumferential direction and radially. The reduction in wall thickness thereby takes place essentially symmetrically, this being advantageous for the production capability of the blade and for the strength of the fin.

According to a development, a wall portion remaining between the depressions located opposite one another may have essentially the same wall thickness as the sealing portion of the fin. Solidification thereby takes place essentially synchronously in the sealing region and in this wall portion, thus simplifying the production of the blade.

Further important features and advantages of the invention may be gathered from the subclaims, from the drawings and from the accompanying figure description with reference to the drawings.

BRIEF DESCRIPTION OF THE DRAWINGS

A preferred exemplary embodiment of the invention is illustrated in the drawings and is explained in more detail in the following description, identical reference symbols relating to identical or functionally identical or similar components. In the drawings, in each case diagrammatically.

EMBODIMENTS OF THE INVENTION

Figure 1:
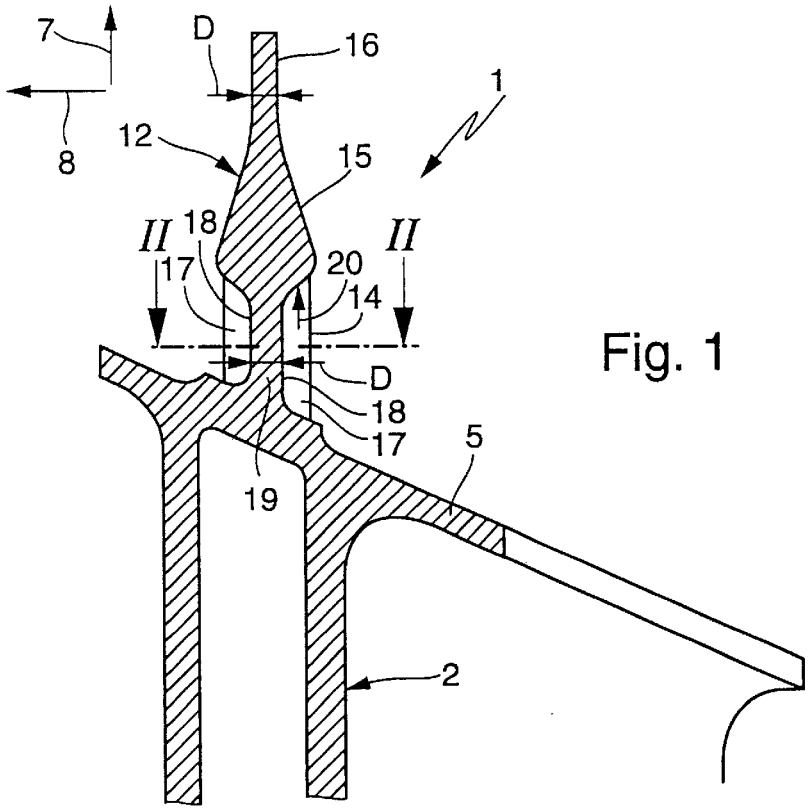
FIG. 1 shows an axial section through a moving blade according to the invention in the region of a fin along the sectional lines I in FIG. 2.
Figure 2:
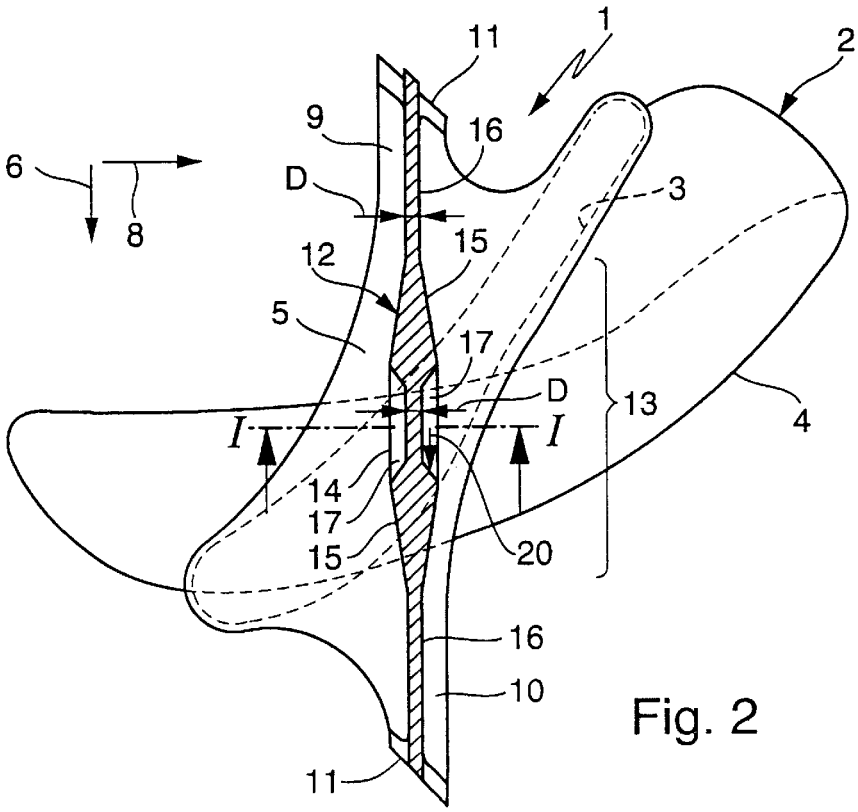
FIG. 2 shows a section through the fin in the circumferential direction along the sectional lines II in FIG. 1.

According to FIGS. 1 and 2, a moving blade 1 according to the invention of a turbomachine, in particular a turbine or a compressor, possesses a profile body 2 which is shaped aerodynamically and, during operation, has a flow passing around it. In FIG. 2, a tip profile formed at the tip of the profile body 2 is illustrated by a broken line and is designated by 3. A foot profile present on the radially inner foot of the profile body is designated by 4. As may be gathered from the run of the profile along the profile body 2, the latter is twisted. The radial direction is in this case symbolized in FIG. 1 by an arrow 7.

The profile body 2 has integrally molded on it, at its radially outer end, a shroud band 5 which, on the one hand, completely covers the tip profile 3 and, on the other hand, projects beyond the profile body 2 in the circumferential direction approximately centrally with respect to the profile body 2. The circumferential direction is in this case symbolized in FIG. 2 by an arrow 6. To complete the reference system, FIGS. 1 and 2 additionally illustrate the axial direction by means of an arrow 8.

The projecting regions of the shroud band 5 are designed in FIG. 2 by 9 and 10 and serve for flow guidance when the moving blade 1 is in operation, in that they obstruct an undesirable flow around the tip of the profile body 2. Furthermore, these regions 9, 10 of the shroud band 5 are dimensioned such that, when the moving blade is in operation, they cooperate with matching regions 9, 10 of adjacent moving blades 1 in order to stabilize the moving blades 1. At the latest when the moving blades 1 are in operation, that is to say with turbine rotor or compressor rotor rotating, the shroud bands 5 of adjacent moving blades 1 come to bear on one another at the regions 9, 10 projecting in the circumferential direction, for which purpose corresponding bearing surfaces 11 are formed at the regions 9, 10. As a result, on the one hand, an additional twisting of the profile body 2 during operation is limited. On the other hand, the mutual support damps the formation of oscillations or increases the frequency of the latter.

So that, during operation, the shroud band 5 is not inadmissibly deformed in its projecting regions 9, 10, a fin 12 is integrally molded on the shroud band 5 radially on the outside. This fin 12 extends in the circumferential direction 6 along the shroud band 5, centrally with respect to the profile body 2, over the entire extent of the shroud band 5, that is to say even in the projecting regions 9, 10. Thus, a T-beam profile, which can be seen in FIG. 1, is formed on the shroud band 5 in the region of the fin 12. The fin 12 thus provides an intensive stiffening of the projecting regions 9, 10, with the result that the shroud band 5 acquires sufficient stability. In a region 13 which is identified in FIG. 2 by a brace and in which the profile body 2 adjoins the shroud band 5, the fin 12 possesses a base portion 14 which merges into the shroud band 5. A transitional portion 15 adjoins this base portion 14 in the radial direction 7 according to FIG. 1 and in the circumferential direction 6 according to FIG. 2. A sealing portion 16 adjoins this transitional portion 15 in the radial direction 7 again according to FIG. 1 and in the circumferential direction 6 according to FIG. 2. With the aid of this sealing portion 16, the fin 12 performs its sealing function, in that it obstructs a flow around the shroud band 5 in the axial direction on its radially outer side.

As may be gathered from FIGS. 1 and 2, a wall thickness, measured in the axial direction 8, of the fin 12 decreases in the transitional portion 15 from the base portion 14 to the sealing portion 16. By virtue of this form of construction, the fin 12 possesses increased strength in the region of the transitional portion 15 and of the base portion 14, so that the necessary rigidity of the shroud band 5 can be ensured.

According to the invention, then, at least one depression 17, which locally reduces the wall thickness of the base portion 14, is integrally molded on the outside of the base portion 14. In the preferred embodiment shown here, two depressions 17 of this type are formed. The two depressions 17 are in this case arranged opposite one another with respect to a plane, not designated in any more detail, of the fin 12, said plane extending in the circumferential direction 6 and in the radial direction 7. The depressions 17 are in each case formed in such a way that they have an opening cross section which lies parallel to the plane of the fin 12 and which is indicated in the figures by an arrow 20 and widens outward in the axial direction 8 with respect to the fin 12. In particular, the depressions 17 may be of frustoconical design. This geometric shaping of the depressions 17 serves for optimizing the stress distribution in the fin 12 during operation and makes it easier to remove the model from the mold.

Each of the depressions 17 possesses a planar bottom 18. These bottoms 18 limit a wall portion 19 which remains as a result of the integral molding of the depressions 17 and which has a smaller wall thickness than the remaining region of the base portion 14 or than the transitional region 15. Expediently, the bottoms 18 of the depressions 17 run essentially parallel to the sealing portion 16 of the fin 12, that is to say essentially parallel to the radial direction 7 and parallel to the circumferential direction 6. In the embodiment shown here, the wall thickness of the base portion 14 is reduced in the region of the depressions 17, that is to say in the wall portion 19, to an extent such that it corresponds essentially to the wall thickness of the sealing portion 16. The same wall thicknesses are identified in FIGS. 1 and 2 by dimensioning arrows and are designated by D.

Expediently, the two depressions 17 are designed symmetrically to an extent such that the wall portion 19 remaining between the depressions 17 is in alignment with the sealing portion 16 of the fin 12 in the radial direction 7 according to FIG. 1 and in the circumferential direction 6 according to FIG. 2. This measure, too, leads to optimization with regard to the stress distribution in the fin 12 and the load-bearing capacity of the latter.

It is particularly important, in this case, that the moving blade 1, including the depressions 17, be designed or produced as a one-part or one-piece cast component. What is achieved by allowing for one or more depressions 17 of this type in the casting mold used for producing the moving blade 1 is that the base portion 14, which per se has a large mass, is reduced in terms of its volume to be cast. The result of this is that, on the one hand, during the casting of the moving blade 1, the fin 12 can cool more quickly in the base portion 14 and, on the other hand, during the solidification process, less melt which continues to flow is required in order to avoid shrinkage. Correspondingly, in the moving blade 1 configured according to the invention, the formation of porous structures can be reduced or avoided. The strength and useful like of the moving blade 1 are thus increased. Furthermore, by virtue of this measure, the weight of the fin 12 can be reduced, in order thereby to reduce the load on the moving blade 1 during operation.

The positioning and geometric shaping and also the number of the depressions 17 are expediently selected such that an optimum is obtained for the stiffening function and the sealing function of the fin 12, on the one hand, and for the production capability and service life of the moving blade 1, on the other hand.

LIST OF REFERENCE SYMBOLS

1 Moving blade
2 Profile body
3 Tip profile of 2
4 Foot profile of 2
5 Shroud band
6 Circumferential direction
7 Radial direction
8 Axial direction
9 Projecting region of 5
10 Projecting region of 5
11 Contact surface
12 Fin
13 Region of 12
14 Base portion of 12
15 Transitional portion of 12
16 Sealing portion of 12
17 Depression in 14
18 Bottom of 17
19 Wall portion

What is claimed is:

1. A moving blade, cast in one piece, for a turbomachine, comprising:

an aerodynamically shaped profile body having a radially outer end including an integrally molded shroud band which projects beyond the profile body in the circumferential direction and which has radially on the outside an integrally molded fin which extends in a circumferential direction along the shroud band and which, at least in a region of the shroud band in which the profile body runs, has a base portion connected to the shroud band, a transitional portion adjoining the base portion radially, circumferentially, or both, and a sealing portion adjoining the transitional portion radially, circumferentially, or both;

an axially measured wall thickness decreasing in the transitional portion from the base portion to the sealing portion; and at least one depression which reduces the wall thickness of the base portion integrally molded on the outside of the base portion.

2. The moving blade as claimed in claim 1, further comprising at least two depressions arranged opposite one another with respect to a plane extending circumferentially and radially.

3. The moving blade as claimed in claim 2, further comprising a wall portion between the depressions located opposite one another in alignment with the sealing portion of the fin.

4. The moving blade as claimed in claim 2, further comprising a wall portion between the depressions located opposite one another having the same wall thickness as the sealing portion of the fin.

5. The moving blade as claimed in claims 1, wherein the wall thickness of the base portion corresponds to the wall thickness of the sealing portion in the region of the at least one depression.

6. The moving blade as claimed in claims 1, wherein the at least one depression has a planar bottom which extends parallel to the sealing portion.

7. The moving blade as claimed in claims 1, wherein the at least one depression is frustoconical.

8. The moving blade as claimed in claims 1, wherein the depression has an opening cross section which widens outward in the axial direction and which runs parallel to a plane of the fin, said plane extending in the circumferential direction and in the radial direction.

9. A turbine comprising a moving blade as claimed in claim 1.

10. A compressor comprising a moving blade as claimed in claim 1.

* * * * *